US006527512B2

(12) United States Patent
Bertin et al.

(10) Patent No.: US 6,527,512 B2
(45) Date of Patent: Mar. 4, 2003

(54) MUD MOTOR

(75) Inventors: Robert D. Bertin, Placerville, CA (US); William D. Nielsen, Jr., Avon Lake, OH (US); Diane M. Ryan, Kingwood, TX (US)

(73) Assignee: Brush Wellman, Inc., Cleveland, OH (US)

( * ) Notice: Subject to any disclaimer, the term of this patent is extended or adjusted under 35 U.S.C. 154(b) by 0 days.

(21) Appl. No.: 09/797,336

(22) Filed: Mar. 1, 2001

(65) Prior Publication Data

US 2002/0122722 A1 Sep. 5, 2002

(51) Int. Cl.[7] ..... F04D 3/02
(52) U.S. Cl. ..... 415/200; 415/901; 416/241 R
(58) Field of Search ..... 415/200, 901, 415/903; 416/241 R; 148/433, 435; 420/473; 175/92, 93, 107

(56) References Cited

U.S. PATENT DOCUMENTS

| | | | | |
|---|---|---|---|---|
| 2,005,889 A | | 6/1935 | Dillon et al. | |
| 3,112,801 A | * | 12/1963 | Clark et al. | 175/107 |
| 3,878,903 A | | 4/1975 | Cherrington | |
| 3,982,859 A | * | 9/1976 | Tschirky et al. | 418/48 |
| 4,484,753 A | | 11/1984 | Kalsi | |
| 4,842,516 A | * | 6/1989 | Choisser | 433/132 |
| 4,852,666 A | | 8/1989 | Brunet et al. | |
| 4,915,552 A | * | 4/1990 | Hillestad et al. | 408/125 |
| 5,195,754 A | | 3/1993 | Dietle | |
| 5,337,840 A | * | 8/1994 | Chancey et al. | 175/107 |
| 5,368,109 A | | 11/1994 | Pittard, Jr. et al. | |
| 5,448,227 A | | 9/1995 | Orban et al. | |
| 5,467,832 A | | 11/1995 | Orban et al. | |
| 5,956,995 A | | 9/1999 | Herben et al. | |
| 6,001,196 A | | 12/1999 | Harkness et al. | |
| 2002/0007879 A1 | | 1/2002 | Nielsen et al. | |

FOREIGN PATENT DOCUMENTS

| | | |
|---|---|---|
| EP | 0 366 567 | 5/1990 |
| EP | 0 841 407 | 5/1998 |

OTHER PUBLICATIONS

Application Data Sheet, "Standard Designation for Wrought and Cast Copper and Copper Alloys," rev. 1999, Copper Dev. Assn.

Harkness et al., Beryllium–Copper and Other Beryllium-Containing Alloys, *Metals Handbook*, vol. 2, 10$^{th}$ Ed., ©1993 ASM Int'l.

William Nielsen, Jr. et al., "Unwrought Continuous Cast Copper–Nickel–Tin Spinodal Alloy," U.S. patent application Ser. No. 08/552,582, filed Nov. 3, 1995.

Harkness et al., "Beryllium–Copper and Other Beryllium-Containing Alloys," *Metals Handbook*, vol. 2, 1990, pp. 403–423, XP002045188, ASM Int'l., Metals Park, ASM, U.S.

* cited by examiner

*Primary Examiner*—Edward K. Look
*Assistant Examiner*—Ninh Nguyen
(74) *Attorney, Agent, or Firm*—Calfee, Halter & Griswold, LLP

(57) ABSTRACT

A fluid powered drilling motor adapted for drilling oil wells and other subterranean bore holes. The motor having a rotor and a stator wherein the iron content of the whole motor is less than 0.1% wt. In one embodiment the motor is made of an alloy having a base metal comprising one of copper, nickel, and aluminum plus about 0.05–10 wt % Beryllium. In another embodiment, the motor is made of either 15Ni-8SN—Cu or 9Ni-6Sn—Cu.

24 Claims, 1 Drawing Sheet

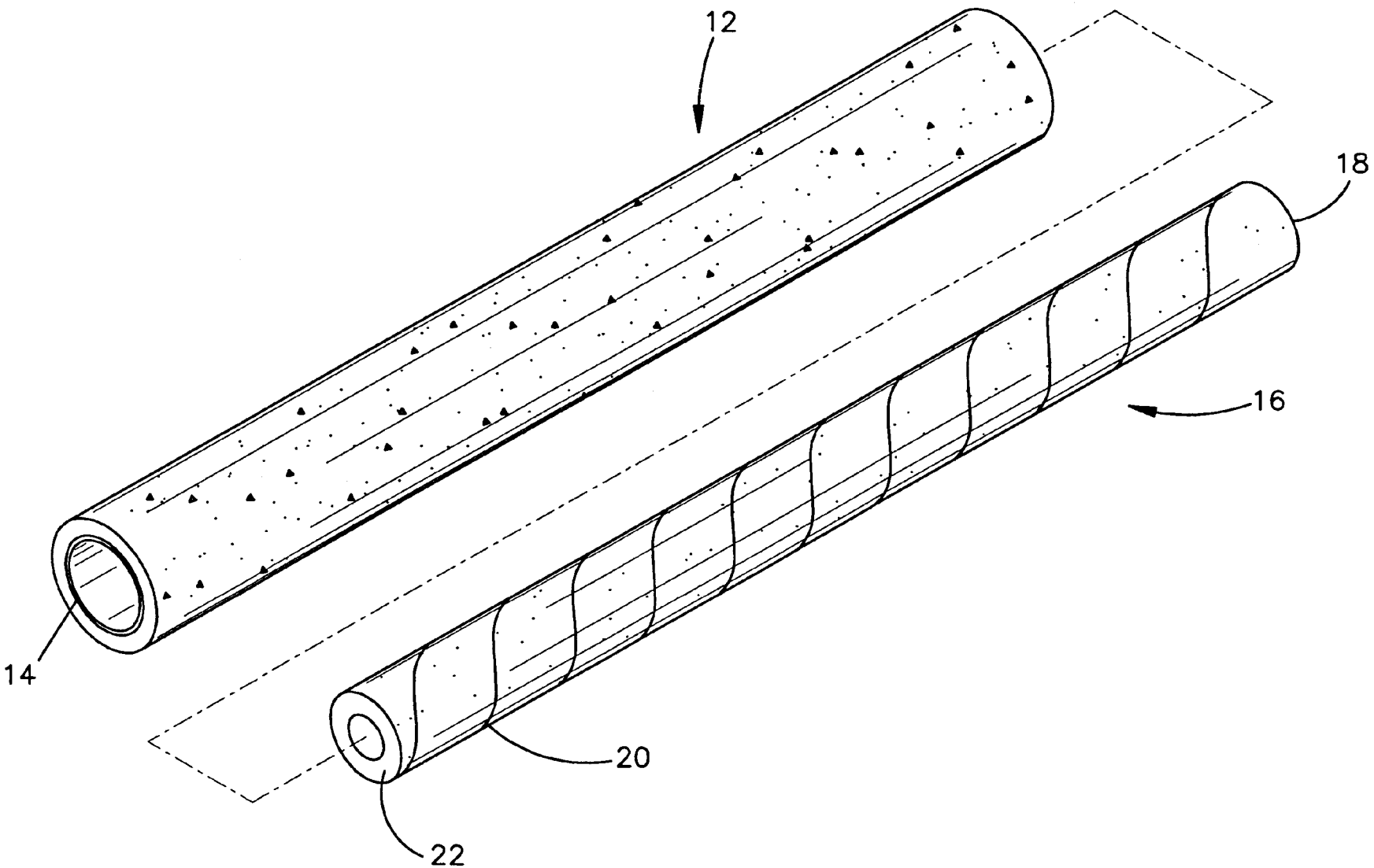
18
16
12
20
22
14

MUD MOTOR

BACKGROUND

1. Field of the Invention

The present invention relates to fluid-powered drilling motors useful for drilling oil wells and other subterranean bore holes 2. Background of the Invention In drilling oil wells and other subterranean bore holes, the motive power to drive the drill bit on the tip of the drill string is normally provided by a fluid-powered drilling motor or "mud motor." Conventional drilling motors are composed of two principle components, a stator housing or "stator" and a rotating screw or impeller (hereinafter "rotor") located inside the stator. A fluid, typically drilling mud in the case of oil wells is pumped down the inside of the drill string at high pressure where it passes through the drilling motor between the stator and rotor to the outside the drill string. The rotor and stator are structured such that movement of fluid between them imparts a rotary motion to the rotor, this rotary motion being transferred to the drill bit for drilling the bore hole. See, for example, U.S. Pat. No. 3,878,903; U.S. Pat. No. 4,484,753; U.S. Pat. No. 5,195,754 and U.S. Pat. No. 5,956,995, the disclosures of which are incorporated herein by reference.

In order to direct the path of the bore hole, modern drilling equipment often includes a guidance system which senses the location of the drill bit and other parameters. Such systems typically include a sensor positioned in the drill string at or near the drill bit and a receiver located at the surface for receiving signals transmitted by the sensor. Based on the sensed location, various actions can be taken to direct, or redirect, the direction of the drill bit so that the bore hole produced achieves the desired location. This is especially important in directional well drilling where the path of the bore hole is changed at some preselected depth from vertically downward to laterally outward. See U.S. Pat. No. 5,467,832 and U.S. Pat. No. 5,448,227, the disclosures of which are also incorporated herein by reference.

Although the location of bore hole pathways can be controlled with reasonable accuracy using current technology, greater accuracy is still desired.

Accordingly, it is an object of the present invention to provide improved drilling equipment which allows the pathways of bore holes produced in subterranean formations to be controlled more accurately than currently possible.

SUMMARY OF THE INVENTION

This and other objects are accomplished by the present invention which is based on the discovery that greater accuracy can be achieved in sensing the underground location of drill bits and/or drilling motors during drilling of a subterranean bore hole if the drilling motor is made from non-magnetic components which are substantially iron-free. In particular, it has been determined in accordance with the present invention that the inability of current guidance systems to sense the location of underground drill bits with high accuracy is due at least in part to magnetic interference caused by the drilling motor or its components. Although non-magnetic alloys are typically used for making the rotors and stators of many drilling motors, over time these alloys can develop localized areas or regions of significant magnetism. These areas of magnetism, in turn, interfere with the signals transmitted by the sensor of the guidance systems to indicate drill bit location. In accordance with the present invention, therefore, the drilling motor is formed from alloys which are not only non-magnetic but also substantially iron-free as well. As a result, the tendency of the drilling motor to develop areas of magnetism over use is largely eliminated.

Thus, the present invention provides an improved drilling motor for use in drilling subterranean bore holes in which the significant components of the drilling motor are formed from alloys which are not only non-magnetic but also contain less than 0.1 weight percent iron. Preferably, the drilling motor is made from components such that the drilling motor, as a whole, contains less than 0.1 weight percent iron, based on the entire weight of the drilling motor.

BRIEF DESCRIPTION OF THE DRAWINGS

The present invention may be more easily understood by reference to the drawing which is a schematic sectional view of the stator and rotor of a drilling motor made in accordance with the present invention.

DETAILED DESCRIPTION

The stator and rotor of a drilling motor made in accordance with the present invention are schematically illustrated in the FIGURE. Stator 12 is composed of a hollow metallic cylinder whose inside cylindrical walls are lined with a polymer insert 14. Rotor 16 is composed of an elongated cylindrical shaft 18, the outer cylindrical surface of which is provided with a helical thread or rib 20 for sealing engagement with polymer insert 14. The distal end 22 of cylindrical shaft 18 is provided with means (not shown) for attaching rotor 16 to a drill bit. When a drilling fluid is charged between rotor 16 and polymer insert 16, rotor 16 rotates inside stator 12 in response to the force imparted on helical rib 20 by the drilling fluid impinging on this member. This rotation, in turn, powers drilling of the bore hole by the drill bit attached to the rotor.

Conventional drilling motors of this type are normally made from iron-based alloys, some of which may be non-magnetic (i.e. having a magnetic permeability of less than 1.01. These alloys, however, even if non-magnetic, still develop regions of significant magnetism over time. This magnetism is enough to interfere with the signals transmitted by the downhole sensor in the guidance system, thereby reducing the accuracy of the sensed location of the drill bit and other variables. In accordance with the present invention, this problem is overcome by forming the significant components of the motor, or at least some of them, from non-magnetic alloys which contain 0.10 wt. % iron or less, preferably 0.05 wt. % iron or less, more preferably 0.01 wt. % iron or less. Especially preferred are alloys which contain no more than trace amounts of iron, i.e. no more than 0.005 wt. % iron. Such alloys should also have a magnetic permeability of less than 1.01, preferably less than 1.005, more preferably less than 1.001. By "significant component" is meant any component of the drilling motor representing at least 10 percent of the mass (i.e. weight) of the drilling motor as a whole.

In this connection, although the FIGURE schematically shows only two significant components in the inventive drilling motor, the rotor and the stator, real drilling motors are typically made from many different components assembled together. Accordingly, in actual practice, the rotor and/or stator of a drilling motor could be made from multiple rather than a single component. In accordance with the present invention, it is desirable that all significant components of the drilling motor, that is all metallic components constituting at least 10 wt. % of the total drilling motor mass, be made from non-magnetic alloys which contain 0.10 wt. % iron or less, preferably 0.05 wt. % iron or less, more preferably 0.01 wt. % iron or less, even more preferably 0,005 wt. % iron or less. Preferably, the drilling motor is made from materials such that the drilling motor, as a whole, contains 0.10 wt. % iron or less, preferably 0.05 wt. % iron or less, more preferably 0.01 wt % iron or less, even more preferably 0.005 wt. % iron or less.

Forming a drilling motor to have a total iron content of less than 0.10 wt. % in accordance with the present invention can be done in a variety of different ways. For example, all of the metallic components of the drilling motor can be made from alloys having an iron content less that 0.10 wt. %. Alternatively, the metallic components of the drilling motor can be formed from different alloys some containing more than 0,10 wt. % iron others containing less, with the amounts of these different alloys being selected such that the total amount of iron in the drilling motor as a whole is less than 0.10 wt. %.

In a preferred embodiment of the present invention, the alloys selected for making the rotor, stator and other significant components of the inventive drilling motor such as the bearings into which the rotor and the driving shafts of the drill bit are mounted, in addition to being nonmagnetic and containing no more than 0.1 wt. % iron, also have a 0.2% yield strength of at least 100 ksi, preferably at least 110 ksi, and an electrical conductivity of at least 6%IACS, preferably at least 8%IACS. More preferably, such alloys further have a corrosion cracking resistance in boiling $MgCl_2$ of greater than 1000 hours, preferably greater than 10,000 hours, as measured by the relative degree of the absence of alloy cracking observed after exposure to boiling $MgCl_2$over extended time versus the same alloy not so exposed, a wear resistance not more than $100\times10e^{-9}$ cu. in., preferably not more than $50\times10e^{-9}$ cu. in., as measured by the volume of material worn away from the alloy after prolonged sliding contact with another metal, and a modulus of elasticity of not more than 20,000 ksi, preferably not more than 18,000 ksi.

Especially preferred alloys are also non-sparking, anti-galling, machineable, plateable and cavitation erosion resistant. By "non-sparking" is meant that no sparks are created by striking the alloy against steel or other metal. By "anti-galling" is meant that the threshold stress above which stress galling may occur, when a force is applied by another metal such as steel to; the alloy surface in a direction normal to the alloy surface, is greater than 75 ksi, By machineable is meant that the alloy has a machinablilty rating of 35 compared to the standard rating given for free cutting brass of 100. By "plateable" is meant that the alloys is significantly easier to electroplate with chromium than iron metal in terms of the energy taken for the plating operation and/or the quality of the plating layer obtained. By "cavitation resistant" is meant that the alloy exhibits less than 0.5% weight loss after 500 minutes exposure to a cavitation fluid flow environment.

Many different commercially available alloys can be used for making the inventive drilling motors. One especially useful type of alloy is composed of at least about 90 wt. % of a base metal comprising copper, nickel or aluminum plus up to about 10 wt. % beryllium, preferably up to about 5 wt. % Be, more preferably up to about 3 wt. % Be. The addition of as little as 0.05 wt. % Be to these base metals produces dramatic enhancements in a number of properties including strength, oxidation resistance, castability, workability, electrical conductivity and thermal conductivity making them ideally suited for making the some or all of the metallic components of the inventive drilling motor. Be additions on the order of at least 0.1 wt. %, more typically 0.2 wt. % are more typical.

These alloys may contain additional elements such as Co, Si, Sn, W, Zn, Zr, Ti and others usually in amounts not exceeding 2 wt. %, preferably not exceeding 1 wt. %, per element. In addition, each of these base metal alloys can contain another of these base metals as an additional ingredient. For example, the Be—Cu alloy can contain Ni or Al as an additional ingredient, again in an amount usually not exceeding 2 wt. %, preferably not exceeding 1 wt. % per element.

These alloys are described, generally, in Harkness et al., Beryllium-Copper and Other Beryllium-Containing Alloys, *Metals Handbook*, Vol. 2, 10th Edition, © 1993 ASM International, the disclosure of which is incorporated by reference herein.

A preferred class of this type of alloy is the 81000 series and the 82000 series of high copper alloys as designated by the Copper Development Association, Inc. of New York, N.Y. Another preferred class of these alloys are the lean, high conductivity, stress relaxation resistant BeNiCu alloys described in U.S. Pat. No. 6,001,196, the disclosure of which is also incorporated herein by reference. These later alloys contain 0.15 to 0.5 wt. % Be, 0.4 to 1.25 wt. % Ni and/or Co, 0 to 0.25 wt. % Sn and 0.06 to 1.0 wt. % Zr and/or Ti. Another preferred alloy can be described as containing more than 1.5 wt. % Be, with the balance being composed mainly of copper and other elements.

Another type of alloy that is especially useful in making the inventive drilling motors is the Cu—Ni—Sn spinodal alloy. These alloys, which contain about 8 to 16 wt. % Ni and 5 to 8 wt. % Sn, spinodally decompose upon final age hardening to provide alloys which are both strong and ductile as well as exhibiting good electrical conductivity, corrosion resistance in $Cl^-$, and cavitation erosion resistance. In addition, they are machineable, grindable, plateable and exhibit good non-sparking and anti-galling characteristics. These alloys are described in U.S. application Ser. No. 08/552,582, filed Nov. 3, 1995, the disclosure of which is also incorporated by reference. Especially preferred alloys of this type include those whose nominal compositions are 15Ni-8Sn—Cu (15 wt. % Ni, 8 wt. % Sn, balance Cu) and 9Ni-6Sn—Cu, which are commonly known as Alloys C72700, C72900 and C96900 under the designation scheme of the Copper Development Association. In addition to Ni and Sn, these alloys may also contain additional elements for enhancing various properties in accordance with known technology as well as incidental impurities. Examples of additional elements are B, Zr, Ti, P, Si and Nb. Iron may also be used, but if so the iron content should be maintained less than 0.1 wt. %, preferably less than 0.05 wt. %, more preferably less than 0.005 wt. %, in accordance with the present invention.

The rotor, stator, bearings and/or other significant components of the inventive drilling motor in accordance with the present invention can be made from alloys which are either in the wrought or the unwrought forms. As well understood in metallurgy, most commercially-available alloys can be characterized as either cast or wrought. See, for example, the APPLICATION DATA SHEET, Standard Designation for Wrought and Cast Copper and Copper Alloys, Revision 1999, published by the Copper Development Association. Wrought alloys are those in which the alloy, after being cast in molten form into a solid article (a "casting" or an "ingot") are subjected to significant, uniform, mechanical working (deformnation without cutting), typically on the order of 40% or more in terms of area reduction, before being sold. Working may have a significant effect on the crystal structure of an as-cast alloy, and accordingly working is done so as to achieve significant and substantially uniform deformation of the as-cast alloy throughout its entire mass. Cast products on the other hand, are those alloys which are not worked significantly before being sold. In other words, they are unwrought.

Alloys useful for making shaped articles are sold commercially in bulk in a variety of different forms including rods, bars, strips, large castings and the like. Transforming these bulk products into discrete, shaped products in final form usually requires subdividing the bulk alloy into sections and then shaping the sections into final form. Shaping often includes some type of cutting operation for removing part of the section and may also include a mechanical deformation step such as bending for imparting a curved or other non-uniform, non-rectilinear or non-orthogonal shape to the section. In some instances, the part fabricator may also work the alloy, before or after sectioning and/or before or after final solution anneal, to affect its crystal structure throughout its bulk.

In accordance with one embodiment of the invention, the drilling motor or at least some of its significant components, such as the bearings, are made from alloys in unwrought form. By "unwrought form" is meant that the alloy forming the component has not been subjected to significant wrought processing anytime during its history. In other words at no time has the alloy forming the part, starting from when it solidified into an as cast ingot and ending when it was transformed into the finished component, been subjected to a wrought processing step for effecting mechanical deformation of the alloy uniformly throughout its bulk by an amount greater than 10% in terms of area ratio. Shaping by mechanical deformation may also affect the crystal structure of the alloy, but this effect typically does not occur uniformly throughout the alloy's bulk, at least where the shaping is done to impart a curved or other non-uniform, non-rectilinear or non-orthogonal shape to the article. Therefore, a component that has been mechanically deformed for imparting a curved or other non-uniform, non-rectilinear or non-orthogonal shape thereto may still be "unwrought in form" even though localized areas of the part have been deformed by more than 10%.

In accordance with another embodiment of the invention, the drilling motor or at least some of its significant components are made from alloys which have been wrought processed. These alloys have been subjected to significant uniform mechanical deformation at some time during manufacture of the final component so that the alloy forming the component exhibits enhanced bulk properties compared with an alloy of identical composition not having been so deformed. Such wrought processing may occur before or after final solution annealing. In those alloys which are age hardenable, i.e. alloys whose properties can be further enhanced by modest heat treatment after final solution annealing such as the Cu—Ni—Sn spinodal alloys mentioned above, wrought processing can occur before or after age hardening.

In an especially preferred embodiment of the invention, the drilling motor or at least some of its significant components are made from the above-mentioned Cu—Ni—Sn spinodal alloys which are made by the technology described in the above-noted U.S. application Ser. No. 08/552,582, filed Nov. 3, 1995. In order to effect good spinodal decomposition of such alloys, it is necessary that the alloys have a relatively fine, uniform grain structure when subjected to age hardening. In prior technology, this enhanced grain structure was achieved by significant mechanical deformation (wrought processing) of the as cast ingot prior to age hardening. However, wrought processing inherently limits the size and complexity of the products which can be produced due to practical constraints on the size and expense of the wrought processing equipment. In the technology of U.S. Ser. No. 08/552,582, molten alloy is introduced into the continuous casting die in a manner such that turbulence is created in zone where the liquid alloy solidifies into solid (referred to hereinafter as "turbocasting"). As a result, a relatively fine, uniform grain structure is achieved in the as cast ingot without wrought processing, thereby making a separate wrought processing step prior to age hardening unnecessary. Accordingly, final products with fully developed spinodal properties can be achieved in bigger sizes and/or more complex shapes, since constraints due to wrought processing before age hardening have been eliminated.

In an especially preferred embodiment of the invention, some or all of the significant parts of the inventive drilling motor are made with this technology. That is to say, these components are made from an alloy which has been derived from a turbocast ingot that has not been wrought processed prior to age hardening and which contains sufficient Cu, Ni and Sn so that the alloy will undergo significant spinodal decomposition on age hardening. With this approach, bigger and more complex parts from these spinodal alloys can be made more easily and inexpensively than possible with other techniques.

Finally, it is also possible in accordance with this aspect of the invention to subject the age hardened components made in this way to wrought processing, before and/or after age hardening, to further enhance their properties. For example, rotors for the inventive mud motors can be advantageously made by turbocasting in the manner described above, then annealing, hot working, annealing again and then age hardening. Stators can be advantageously made by the same approach, optionally including a cold working step after hot working and before age hardening.

The inventive drilling motors are especially adapted for use in drilling subterranean bore holes. To this end, the rotors of these drilling motors will typically range in size from as little as 0.5 inch to as large as 10 inches or even larger. Rotors with diameters of at least 1, at least 2, at least 3 and at least 4 inches are contemplated. These motors are therefore entirely different from small scale motors, such as dentists' drill, whose rotors are typically less than 0.25 inch in diameter and which develop less than 1 horsepower of power.

Although only a few embodiments of the invention have been described above, many modifications can be made without departing from the spirit and scope of the invention. All such modifications are intended to be included within the scope of the present invention, which is to be limited only by the following claims.

We claim:

1. A fluid-powered drilling motor adapted for drilling bore-holes in subterranean formations, the drilling motor including a rotor and a stator, each of the rotor and stator being formed from a non-magnetic alloy containing no more than 0.1 wt. % iron and exhibiting a corrosion cracking resistance in boiling $MgCl_2$ of greater than 1000 hours, and further wherein the iron content of the drilling motor, as a whole, is no more than 0.1 weight percent based on the entire weight of the drilling motor.

2. The drilling motor of claim 1, wherein the total iron content of the drilling motor, as a whole, is no more than 0.05 weight percent.

3. The drilling motor of claim 1, wherein the alloy has a 0.2% yield strength of at least 100 ksi, an electrical conductivity of at least 6% IACS and a wear resistance of not more than $100\times10e^{-9}$ cu. in.

4. The drilling motor of claim 3, wherein the alloy is composed of at least about 90 wt. % of a base metal comprising copper, nickel or aluminum plus about 0.05 to about 10 wt. % beryllium.

5. The drilling motor of claim 4, wherein the alloy contains about 0.1 to about 5 wt. % Be.

6. The drilling motor of claim 3, wherein the alloy is a spinodal copper alloy containing about 5 to 16 wt. % Ni and about 5 to 10 wt. % Sn.

7. The drilling motor of claim 6, wherein the alloy is 15Ni-8Sn—Cu or 9Ni-6Sn—Cu.

8. The drilling motor claim 6, wherein the alloy has been derived from a turbocast ingot.

9. The drilling motor of claim 1, wherein the alloy is composed of at least about 90 wt. % of a base metal comprising copper, nickel or aluminum plus about 0.05 to about 10 wt. % beryllium.

10. The drilling motor of claim 9, wherein the alloy contains about 0.1 to about 5 wt. % Be.

11. The drilling motor of claim 1, wherein the alloy is a spinodal copper alloy containing about 5 to 16 wt. % Ni and about 5 to 10 wt. % Sn.

12. The drilling motor of claim 11, wherein the alloy is 15Ni-8Sn—Cu or 9Ni-6Sn—Cu.

13. The drilling motor claim 11, wherein the alloy has been derived from a turbocast ingot.

14. The drilling motor of claim 1, wherein at least one of the stator and rotor is formed from an alloy composed of at least about 90 wt. % of a base metal comprising copper, nickel or aluminum plus about 0.05 to about 10 wt. % beryllium.

15. The drilling motor of claim 14, wherein at least one of the stator and rotor is formed from an alloy composed of at least about 90% Cu and about 0.1 to about 3 wt. % Be.

16. The motor of claim 1, wherein at least one of the stator and rotor is formed from a spinodal copper alloy containing about 5 to 16 wt. % Ni and 5 to 10 wt. % Sn.

17. A stator for use in a fluid-powered drilling motor adapted for drilling subterranean bore holes, the stator being formed from a non-magnetic alloy containing no more than 0.1 wt. % iron and exhibiting a corrosion cracking resistance in boiling $MgCl_2$ of greater than 1000 hours.

18. The stator of claim 17, wherein the alloy is composed of at least about 90 wt. % of a base metal comprising copper, nickel or aluminum plus about 0.05 to about 10 wt. % beryllium.

19. The stator of claim 17, wherein the stator is formed from a spinodal copper alloy containing about 5 to 16 wt. % Ni and 5 to 10 wt. % Sn.

20. The stator of claim 19, wherein the alloy has been derived from a turbocast ingot.

21. A rotor for use in a fluid-powered drilling motor adapted for drilling subterranean bore holes, the rotor being formed from a non-magnetic alloy containing no more than 0.1 wt. % iron and exhibiting a corrosion cracking resistance in boiling $MgCl_2$ of greater than 1000 hours.

22. The rotor of claim 21, wherein the alloy is composed of at least about 90 wt. % of a base metal comprising copper, nickel or aluminum plus about 0.05 to about 10 wt. % beryllium.

23. The rotor of claim 22, wherein the rotor is formed from a spinodal copper alloy containing about 5 to 16 wt. % Ni and 5 to 10 wt. % Sn.

24. The rotor of claim 23, wherein the alloy has been derived from a turbocast ingot.

* * * * *